US011427395B2

(12) United States Patent
Leflond et al.

(10) Patent No.: US 11,427,395 B2
(45) Date of Patent: Aug. 30, 2022

(54) DEVICE FOR STORING AND DISPENSING AT LEAST ONE BULK PRODUCT

(71) Applicants: VRACOOP, Bidart (FR); BULK AND CO, Bazarnes (FR)

(72) Inventors: Sébastien Leflond, Bidart (FR); Vincent Collet, Bidart (FR); Thibaut Pougeoise, Bidart (FR)

(73) Assignees: VRACOOP, Bidart (FR); BULK AND CO, Bazarnes (FR)

( * ) Notice: Subject to any disclaimer, the term of this patent is extended or adjusted under 35 U.S.C. 154(b) by 113 days.

(21) Appl. No.: 16/770,451

(22) PCT Filed: Dec. 3, 2018

(86) PCT No.: PCT/EP2018/083387
§ 371 (c)(1),
(2) Date: Jun. 5, 2020

(87) PCT Pub. No.: WO2019/110532
PCT Pub. Date: Jun. 13, 2019

(65) Prior Publication Data

US 2020/0346844 A1 Nov. 5, 2020

(30) Foreign Application Priority Data

Dec. 5, 2017 (FR) ..... 1761617

(51) Int. Cl.
*B65D 83/06* (2006.01)
*A47F 3/02* (2006.01)

(52) U.S. Cl.
CPC ..... *B65D 83/06* (2013.01); *A47F 3/02* (2013.01)

(58) Field of Classification Search
CPC . B65D 83/06; B65D 83/00; A47F 3/02; A47F 1/03
See application file for complete search history.

(56) References Cited

U.S. PATENT DOCUMENTS 977,095 A * 11/1910 Hughes ..... B65D 25/48 222/567
2,670,108 A * 2/1954 Fuller ..... B65G 11/026 222/561

(Continued)

FOREIGN PATENT DOCUMENTS

DE 1953128 A1 1/1971

OTHER PUBLICATIONS

International Search Report and Written Opinion, dated Dec. 19, 2018, from corresponding PCT application No. PCT/EP2018/083387.

*Primary Examiner* — Vishal Pancholi
*Assistant Examiner* — Bob Zadeh
(74) *Attorney, Agent, or Firm* — Nixon & Vanderhye

(57) ABSTRACT

Disclosed is a storage and dispensing device which includes: —a container for at least one bulk product in the form of a rigid or semi-rigid box used to package the bulk product from a production and/or packaging location to a sales point, the container including at least one opening configured to allow the bulk product to flow out of the container, —a dispensing system which has an orifice and a closing unit that is movable between an open state, in which it at least partially frees up the orifice and allows the bulk product to flow, and a closed state, in which it closes off the orifice and prevents the bulk product from flowing, —a slide link ensuring a reversible connection between the container and the dispensing system positioned in line with the opening of the container.

14 Claims, 2 Drawing Sheets

(56) References Cited

U.S. PATENT DOCUMENTS

| | | | | |
|---|---|---|---|---|
| 3,966,086 | A * | 6/1976 | Kelso | A47F 1/03 221/234 |
| 4,899,908 | A * | 2/1990 | Kardiak | A47F 3/02 222/1 |
| 5,934,498 | A * | 8/1999 | Jordan | B65D 17/4012 220/270 |
| 7,178,697 | B2 | 2/2007 | Brundick et al. | |
| 2004/0222232 | A1 | 11/2004 | Jespersen et al. | |
| 2014/0124536 | A1* | 5/2014 | Pappalardo | B05C 17/00553 222/137 |
| 2020/0346844 | A1* | 11/2020 | Leflond | A47F 1/03 |

* cited by examiner

DEVICE FOR STORING AND DISPENSING AT LEAST ONE BULK PRODUCT

BACKGROUND OF THE INVENTION

Field of the Invention

This application relates to a device for storing and dispensing at least one bulk product.

Description of the Related Art

In the field of dispensing, certain products are marketed in bulk, such as, for example, seeds, cereal grains, pastes, etc., and the consumer can select the amount of product that he wants to buy.

For this purpose, the products that are initially packaged in packets and/or in boxes are poured into bins that each have, in the lower part, a spout equipped with a flap that can be activated using a handle. To use it, the consumer places a packet at the end of the spout and activates the handle to control the amount of product poured into the packet.

An example of a device for storing and dispensing bulk products is described in particular in the document U.S. Pat. No. 7,178,697. This device comprises a bin made of rigid plastic in the form of a tube that has, in the lower part, an inclined section that directs the bulk product to a spout. The upper opening of the bin is closed by a cover.

The device comprises, at the spout, a flap that is able to move in rotation, around a pivoting axis, between a closed position, in which it totally closes off the spout and prevents the flow of stored bulk product, and a more or less open position in which the flap does not totally close off the spout and allows a more or less significant flow of the stored bulk product. The flap is connected to a handle that makes it possible for a user to pivot the flap around its pivoting axis.

This type of device is not completely satisfactory for the following reasons.

According to a first drawback, to the extent that a sales site generally comprises multiple storing and dispensing devices, the initial investment for the purchase of all of the devices is relatively significant.

According to a second drawback, the daily management of all of the storing and dispensing devices takes a significant amount of time. Actually, it is necessary to fill and clean regularly each of the devices present on the sales site.

Finally, according to a third drawback, even if it is possible to use each of the storing and dispensing devices for marketing various products in succession, it is necessary to modify the labeling of devices uniformly to make it possible to track the products being marketed.

The document U.S. Pat. No. 977,095 describes a pour spout that is attached to the cover of a container. A lock that is trapezoidal in shape is attached to the cover in such a way that the edges of the lock are located away from the cover. The lock and the cover comprise aligned openings. The pour spout is integral with a plate that has approximately the same shape as the lock. This plate has curved edges that work with the edges of the lock. Thus, the curved edges of the plate and the edges of the lock form a sliding connection. The lock comprises folds that, once folded back onto the plate supporting the pour spout, immobilize it.

This embodiment is not satisfactory because it is necessary to attach a lock to the box in order to attach in a removable manner the pour spout to the box, which adds to the cost of the box.

SUMMARY OF THE INVENTION

The purpose of this invention is to eliminate the drawbacks of the prior art.

For this purpose, the invention has as its object a storing and dispensing device that comprises:

- A container of at least one bulk product in the form of a rigid or semi-rigid box used to package the bulk product from a production and/or packaging site to a sales point, with said container comprising at least one cover configured to make it possible for the bulk product to flow outside of the container,
- A dispensing system that has an orifice and a closing means that is able to move between an open state, in which it at least partially frees up the orifice and allows the flow of bulk product, and a closed state, in which it closes off the orifice and prevents the flow of bulk product,
- A sliding connection that ensures a detachable connection between the container and the dispensing system positioned to the right of the opening of the container.

According to the invention, the container and the dispensing system are separate. Thus, the same dispensing system can be mounted in succession on multiple containers.

This solution makes it possible to reduce the amount of the initial investment that is limited to the dispensing systems, with the latter having a cost that is considerably lower than that of a complete storing and dispensing device of the prior art.

According to another aspect, it is no longer necessary to deal with the labeling, with the containers being already marked.

According to another advantage, the containers no longer need to be filled or cleaned on the sales site. When a container is empty, it is replaced by a new container. It can be collected so as to be recycled or reused and filled again with a bulk product.

According to another characteristic, the sliding connection is created by cooperating shapes of the dispensing system and the opening of the container.

Thus, the detachable connection that links the dispensing system and the container is created without adding elements that are connected to the container, which makes it possible to reduce the costs of the container.

According to another characteristic, the sliding connection comprises, on the one hand, first and second wings, integral with the dispensing system, and, on the other hand, C shapes at the opening that ensure the operation of guides for guiding the wings.

According to another characteristic, the dispensing system comprises a frame that delimits a passage for the bulk product and that has two opposite sides in the form of thin coplanar bands of material that constitute the first and second wings.

According to a first variant, the opening comprises:

- A first rectangular portion that has a width that is smaller than the width that separates the outside edges of the wings and very slightly larger than the width of a body of the dispensing system at which the orifice is made and on which the closing means is mounted, and
- At least a second portion, rectangular and expanded, which has a width that is larger than the width of the wings and which has ends arranged on both sides of the first portion and which each describe a C shape that ensures the operation of guides.

According to an embodiment, the opening has a T shape, with the second expanded rectangular portion being positioned above the first portion when the container is positioned ready to dispense the bulk product.

According to this embodiment, the opening is separated from an end face of the container by a distance such that the opening coincides with the passage of the frame when said frame is in contact with the end face of the container.

According to another characteristic, the opening is delimited by a pre-scored line that is made on one of the walls of the container, with this pre-scored line being configured to be cut out in such a way as to create the opening when the container is converted into a part of a storing and dispensing device.

According to another characteristic, the dispensing system comprises a body, connected to a frame, which comprises:

- A semi-cylindrical wall whose first end is connected to a first side of the frame and whose second end is extended by a flat wall connected to a second side of the frame that is opposite to the first side, with the orifice being made at the lower half of the semi-cylindrical wall,
- A first side wall that connects the semi-cylindrical wall and the flat wall to a third side of the frame,
- A second side wall that connects the cylindrical wall and the flat wall to a fourth side of the frame, opposite to the third side,
- A tab, one end of which is connected to the body, between the orifice and the first side of the frame, with said tab extending downward and being slightly inclined in relation to the vertical to direct the stream of bulk product that flows from the orifice when the dispensing system is mounted on a container that is ready to dispense the bulk product.

BRIEF DESCRIPTION OF THE DRAWINGS

Other characteristics and advantages will emerge from the following description of the invention, a description that is provided only by way of example, with regard to the accompanying drawings, among which.

DESCRIPTION OF THE PREFERRED EMBODIMENTS

Figure 5A:
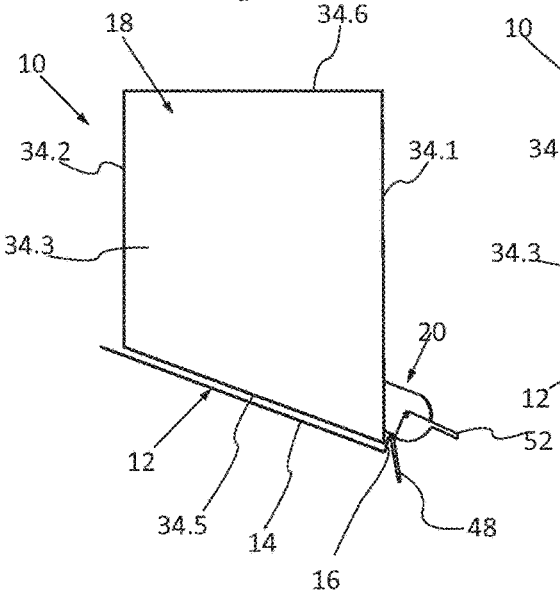
FIGS. 5A and 5B are side views of a storing and dispensing device that illustrate an embodiment of the invention, respectively in the closed state and in the open state.
Figure 5B:
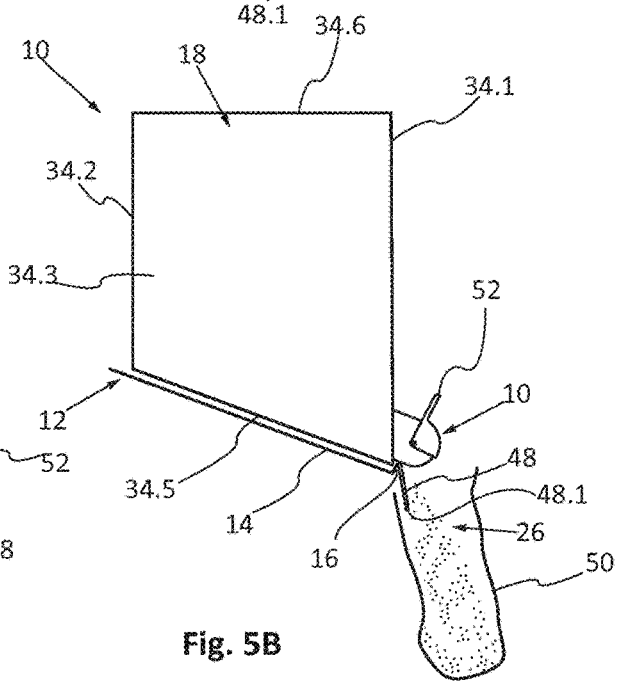

FIGS. 5A and 5B show at 10 a device for storing and dispensing at least one bulk product, positioned on a display unit 12.

According to an embodiment that is non-limiting and provided by way of example, the display unit 12 comprises an inclined plate 14 that is configured to accommodate multiple storing and dispensing devices 10 that are adjacent to one another.

At its lower edge, this inclined plate 14 comprises a flange 16 against which rests each storing and dispensing device 10 positioned on the inclined plate 14.

Of course, the invention is not limited to this embodiment for the display unit 12.

As a variant, the storing and dispensing device could be suspended or held by any other means.

The storing and dispensing device 10 comprises a container 18 with at least one bulk product, a dispensing system 20 that has an orifice 22 (shown in FIG. 4), a closing means 24 that is able to move between an open state, in which it at least partially frees up the orifice 22 and allows the flow of bulk product 26 (as illustrated in FIG. 5B), and a closed state, in which it closes off the orifice 22 and prevents the flow of bulk product (as illustrated in FIG. 5A) as well as a sliding connection 28 that ensures a detachable connection between the container 18 and the dispensing system 20.

Figure 1:
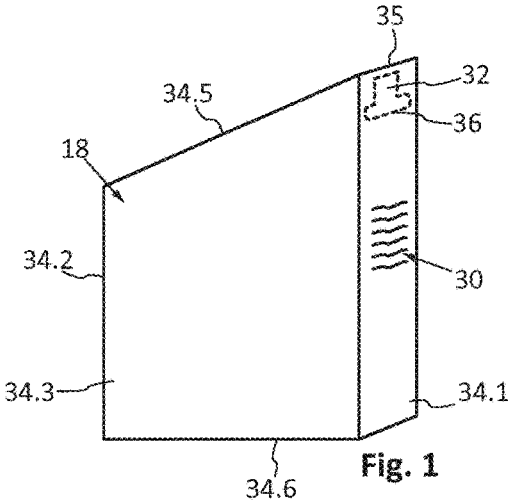
FIG. 1 is a view of a container that is used for packaging a bulk product and configured to constitute a part of a dispensing and storing device according to the invention.

As illustrated in FIGS. 1, 5A, and 5B, the container 18 is a rigid or semi-rigid box, made of cardboard, for example.

According to a characteristic of the invention, the container 18 is the packaging that is used to package the bulk product 26 from a production and/or packaging site to a sales point.

Thus, unlike the prior art, the bulk product stored in its packaging is not poured into a storing and dispensing device that is separate from the packaging. According to the invention, the packaging of the bulk product 26 forms a part of the storing and dispensing device.

The container 18 comprises an inside face in contact with the bulk product 26 and a visible outside face.

The inside face of the container 18 can comprise a surface treatment, a coating, or a covering to reinforce its seal, to make it hydrophobic and/or greaseproof. As a variant, the material used for the container can be cardboard or a similar material having greaseproof, hydrophobic, and/or impermeable properties.

The outside face of the container 18 comprises at least one marking 30 for identifying the product, for the traceability of the product, and/or for indicating any information that is necessary to the sale. Thus, the invention can make it possible to eliminate all of the labeling operations on the sales site.

The container 18 comprises at least one opening 32 configured to link the interior of the container 18 with the exterior and to make it possible for the bulk product 26 to flow to the outside of the container 18 via the dispensing system 20.

The opening 32 is positioned in such a way as to allow a complete or almost-complete emptying of the container 18 when the latter is equipped with the dispensing system 20 and correctly positioned for dispensing the bulk product.

According to an embodiment, the container 18 comprises a front face 34.1, a rear face 34.2, two side faces 34.3, 34.4, a first end face 34.5, and a second end face 34.6.

The front, rear, and side faces 34.1 to 34.4 are connected two by two and are perpendicular to one another in such a way as to form a square or rectangular cross-section.

According to a special feature, the first end face 34.5 is oriented upward when the container 18 is not used as a part of a storing and dispensing device 10 and oriented downward, positioned against a display unit 12, for example, when the container 18 is used as a part of a storing and dispensing device 10.

In contrast, the second end face 34.6 is oriented downward when the container 18 is not used as a part of a storing and dispensing device 10 and oriented upward when the container 18 is used as a part of a storing and dispensing device 10.

The second end face 34.6 can be perpendicular to the front, rear, and side faces 34.1 to 34.4.

To facilitate the emptying of the container 18, the first end face 34.5 comprises at least one inclined section for directing the bulk product 26 toward the front face 34.1, with the opening 32 being positioned on the front face 34.1 close to the edge 35 that connects the front face 34.1 and the first end face 34.5.

The invention is not limited to this geometry for the container 18. By way of example, the first end face 34.5 can comprise multiple inclined sections. Likewise, the front face 34.1 cannot be flat but can have at least one inclined section.

In general, the marking 30 is affixed to the front face 34.1.

When the container 18 is not used as a part of a storing and dispensing device 10, the opening 32 is closed off. It is only open when the container 18 is used as a part of a storing and dispensing device 10. This solution makes it possible to protect the bulk product 26.

According to a first embodiment, the opening 32 is closed off by a lid.

According to a second embodiment, the opening 32 is delimited by a pre-scored line 36 (shown in FIG. 1) that is made on one of the walls of the container 18 (in particular on its front face 34.1). This pre-scored line 36 is configured to be cut out in such a way as to create the opening 32 when the container 18 is converted from packaging into a part of a storing and dispensing device 10.

Of course, the invention is not limited to these two embodiments to create the opening 32 when the container 18, used initially as packaging, is converted into a part of a storing and dispensing device 10.

The dispensing system 20 comprises:

- A frame 38 that delimits a passage that works with the opening 32 of the container 18 during operation,
- A body 40 that delimits a cavity 42 that communicates with the passage and the orifice 22, and
- The closing means 24.

Figure 2:
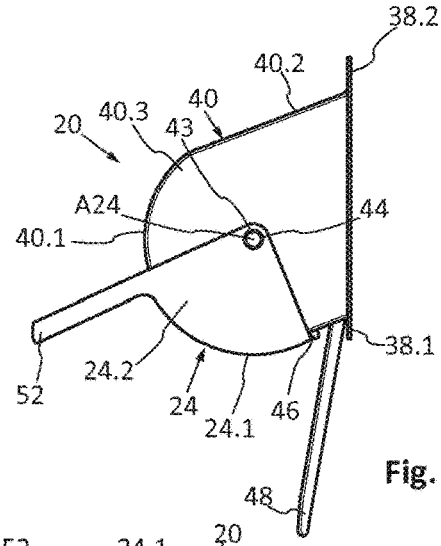
FIG. 2 is a side view of a dispensing system, in the closed state, which illustrates an embodiment of the invention.
Figure 3:
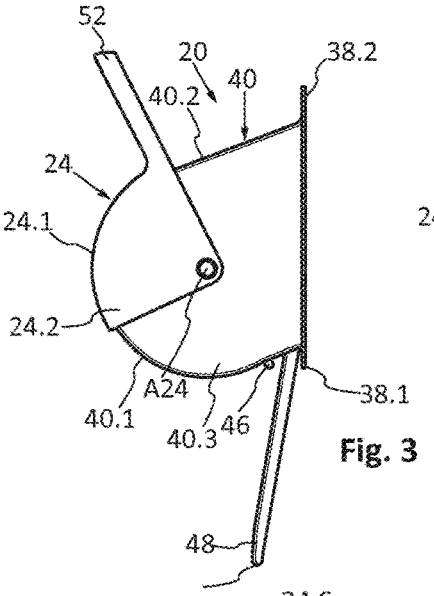
FIG. 3 is a side view of the dispensing system that is shown in FIG. 2, in the open state.
Figure 4:
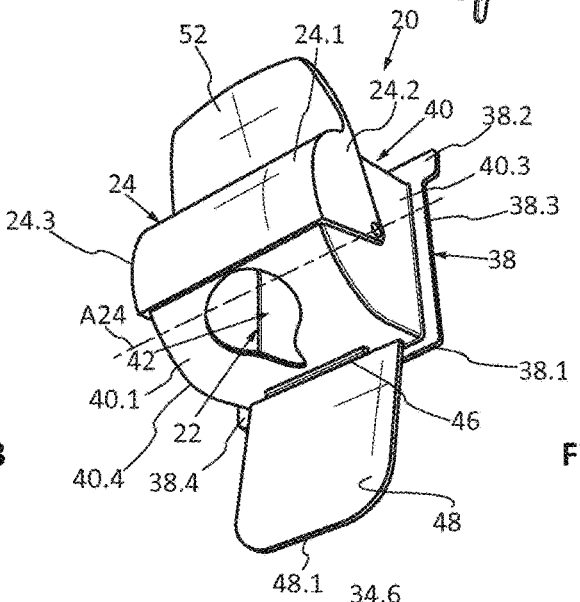
FIG. 4 is a perspective view of the dispensing system that is shown in FIG. 2, in the open state.

According to an embodiment that is shown in FIGS. 2 to 4, the body 40 comprises:

- A semi-cylindrical wall 40.1 whose first end is connected to a first side 38.1 of the frame 38 and whose second end is extended by a flat wall 40.2 connected to a second side 38.2 of the frame 38, opposite to the first side 38.1,
- A first side wall 40.3 that connects the semi-cylindrical wall 40.1 and the flat wall 40.2 to a third side 38.3 of the frame 38, and
- A second side wall 40.4 that connects the cylindrical wall 40.1 and the flat wall 40.2 to a fourth side 38.4 of the frame 38, opposite to the third side 38.3.

The first and second side walls 40.3 and 40.4 are parallel to one another and perpendicular to the axis of the semi-cylindrical wall 40.1.

The semi-cylindrical, flat, side walls 40.1 to 40.4 of the body delimit the cavity 42.

According to an embodiment, the frame 38 and the body 40 form only a single piece, for example made of plastic, obtained by injection, molding, or any other method.

According to an embodiment, the closing means 24 comprises:

- A one-quarter-cylinder wall 24.1 configured to cover the semi-cylindrical wall 40.1 of the body 40 and to slide over the outside face of the latter,
- A first side wall 24.2 configured to be flattened against the first side wall 40.3 of the body 40, outside of the latter, and
- A second side wall 24.3 configured to be flattened against the second side wall 40.4 of the body 40, outside of the latter.

The first and second side walls 24.2 and 24.3 each have a one-quarter-disk shape.

The closing means 24 is able to move around a pivoting axis A24 merged with the axis of the semi-cylindrical wall 40.1 of the body 40.

According to an embodiment, the first and second side walls 40.3, 40.4, 24.2, 24.1 of the body 40 and the closing means 24 have shapes that work with one another in such a way as to form the pivoting axis A24.

According to an embodiment, each side wall 40.3, 40.4 of the body 40 comprises a cylindrical pin 43 that projects toward the outside of the body 40. In addition, each side wall 24.2, 24.3 of the closing means 24 comprises a cylindrical hole 44, of the same diameter as the pin 42, configured to accommodate it.

Of course, the invention is not limited to this embodiment for forming a pivoting axis between the closing means 24 and the body 40.

According to a configuration, the orifice 22 is made in the semi-cylindrical wall 40.1 at its lower half, close to the first side 38.1 of the frame 38, at the lowest portion of the body 40 when the storing and dispensing device 10 is positioned ready to dispense the bulk product.

The closing means 24 is able to move in rotation around the pivoting axis A24 between the closed state, shown in FIG. 2, in which the one-quarter-cylinder wall 24.1 covers the lower half of the semi-cylindrical wall 40.1 of the body 40 and closes off the orifice 22, and the open state, shown in FIG. 3, in which the one-quarter-cylinder wall 24.1 does not totally cover the lower half of the semi-cylindrical wall 40.1 of the body 40 and at least partially frees up the orifice 22.

The orifice 22 is shaped like a water droplet, with the point 22.1 being oriented toward the first side 38.1 of the frame.

According to a configuration, the orifice 22 is centered between the two side walls 40.3, 40.4 of the body 40 and extends over the entire lower half of the semi-cylindrical wall 40.1.

The body 40 comprises a stop 46, positioned close to the first side 38.1 of the frame 38, projecting in relation to the outside surface of the semi-cylindrical wall 40.1, with the closing means 24 being in contact with said stop 46 in the closed state.

According to an embodiment, the dispensing system 20 comprises a tab 48, one end 48.1 of which is connected to the body 40, between the orifice 22 and the first side 38.1 of the frame 38. When the dispensing system 20 is mounted on a container 18 that is ready to dispense the bulk product, this tab 48 extends downward, slightly inclined in relation to the vertical, to direct the stream of bulk product 26 that flows from the orifice 22.

This tab 48 simplifies the positioning of a packet 50 into which the bulk product 26 is poured. During operation, the packet 50 is threaded around the tab 48, with a part of the packet 50 being in contact against the tab 48, the packet 50 being open at the front of the tab 48.

The closing means 24 comprises a handle 52 for manipulating it.

According to an embodiment that is shown in FIGS. 2 to 4, the handle 52 comes in the form of a plate positioned in a plane passing through the pivoting axis A24, at the upper edge of the one-quarter-cylinder wall 24.1 of the closing means 24.

According to a configuration, the closing means 24 is designed in such a way that it is automatically positioned in the closed state without the action of an individual.

To bring about the flow of bulk product 26, a user lifts the handle 52 to pivot the closing means 24 around the pivoting axis A24. Based on the position of the handle 52, the closing means 24 more or less frees up the orifice 22.

According to a special feature of the invention, the sliding connection 28 comprises two wings 54.1, 54.2 integral with the dispensing system 20, arranged on both sides of the body 40, as well as two guides 56.1, 56.2 integral with the container 18, arranged on both sides of the opening 32 and configured to guide the wings 54.1, 54.2 in a direction for introduction 58 parallel to the front face 34.1 of the container 18.

According to an embodiment, the third and fourth sides 38.3, 38.4 of the frame 38 come in the form of thin coplanar bands of material, parallel to the pivoting axis A24. According to this embodiment, the frame 38 can be flat, where the four sides 38.1 to 38.4 come in the form of thin coplanar bands of material.

Figure 6A:
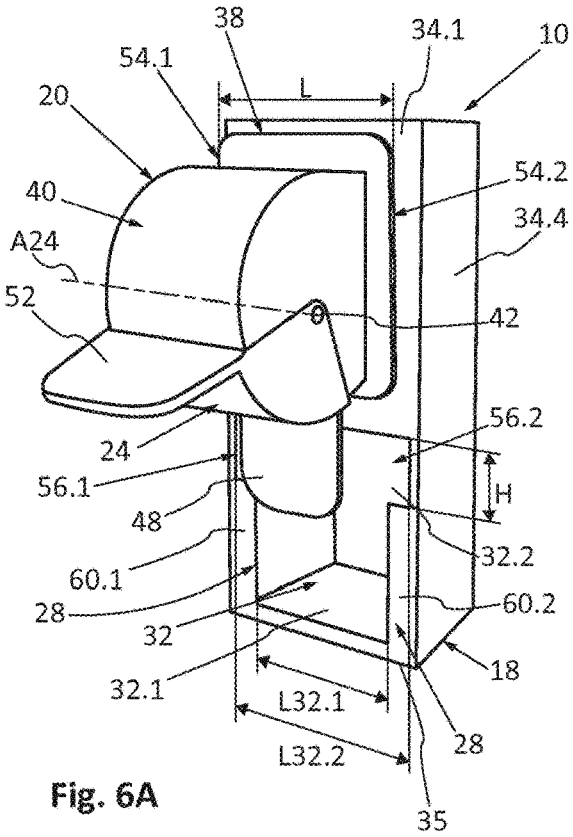
FIGS. 6A to 6C are perspective views that illustrate the installation of a dispensing system on a container so as to obtain a storing and dispensing device according to an embodiment of the invention.
Figure 6B:
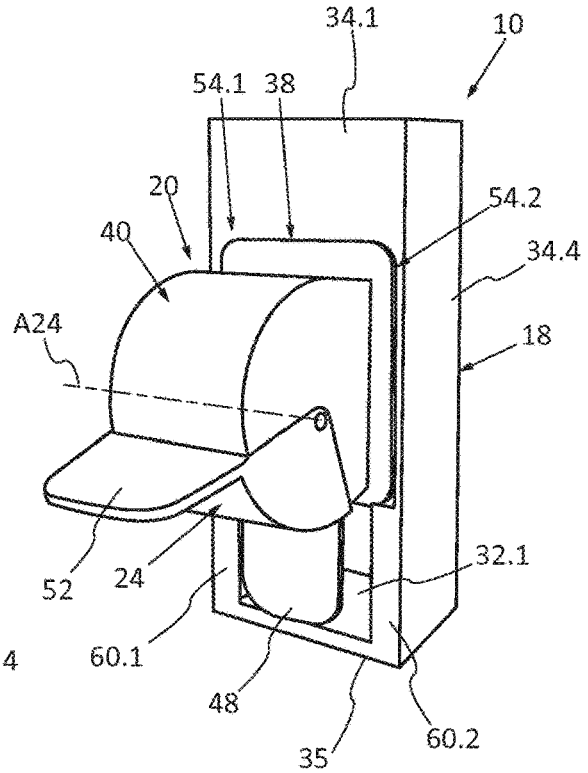
Figure 6C:
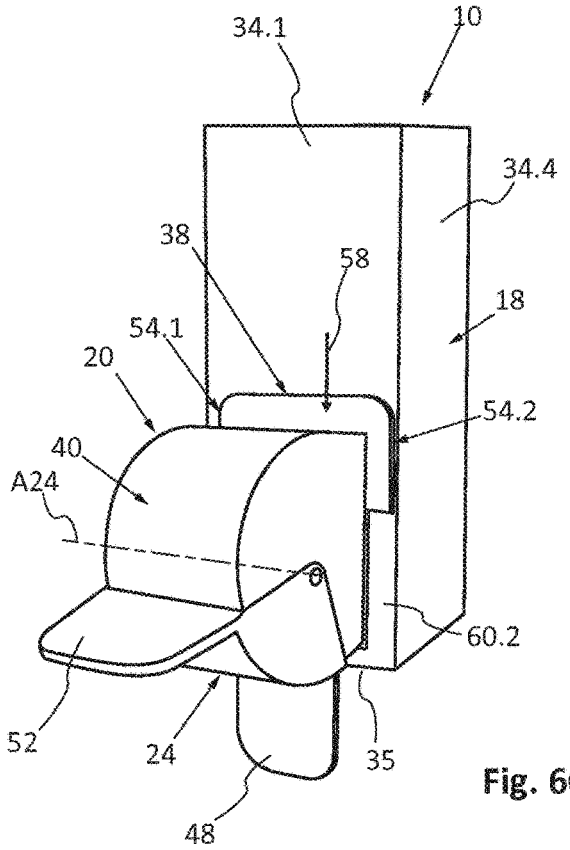

According to an embodiment illustrated by FIGS. 6A to 6C, the opening 32 comprises a first rectangular portion 32.1 that has a width L32.1 that is smaller than the width L separating the outside edges of the wings 54.1, 54.2 and very slightly larger than the width L40 of the body 40 and at least a second rectangular and expanded portion 32.2 that has a width L32.2 that is larger than the width L of the wings 54.1, 54.2.

According to an embodiment that is shown in FIGS. 6A to 6C, the opening 32 has a T shape and comprises a first rectangular portion 32.1 and a second expanded rectangular portion 32.2 positioned above the first portion 32.1 when the container 18 is positioned ready to dispense the bulk product. The ends of the second expanded rectangular portion 32.2, arranged on both sides of the first portion 32.1, each describe a C shape and ensure the operation of guides 56.1, 56.2.

According to this embodiment, the opening 32 is separated from an end face of the container 18, more particularly from the first end face 34.5, by a distance essentially equal to the width of the first side 38.1 of the frame 38 in such a way that the opening 32 coincides with the passage of the frame 38 when the dispensing system 20 is mounted on the container 18, as illustrated in FIG. 6C, and the frame 38 is in contact with the end face 34.5.

The zones 60.1, 60.2 of the front face 34.1, arranged on both sides of the first portion 32.1 of the opening 32 and under the second portion 32.2, make it possible to hold the frame 38 when the dispensing system 20 is mounted on the container 18. The second portion 32.2 of the opening 32 is to have a height H (dimension measured in a direction perpendicular to the edge 35) that is the smallest possible for proper holding of the dispensing system 20 by the zones 60.1, 60.2. This height H is to be adequate, however, for making it possible to introduce the frame 38.

As illustrated in FIG. 6A, before being introduced into the opening 32, the frame 38 is flattened against the front face 34.1 of the container 18. As illustrated in FIG. 6B, the first side 38.1 of the frame 38 is introduced into the second portion 32.2 of the opening 32, and the ends of the wings 54.1, 54.2, formed by the third and fourth sides of the frame 38, are positioned inside the container 18 at the rear of the zones 60.1, 60.2 of the front face 34.1. Next, the dispensing system 20 is moved in the direction of introduction 58 (perpendicular to the edge 35). The wings 54.1, 54.2 slide in the guides 56.1, 56.2 formed by the ends in the shape of a C of the second portion 32.2 of the opening 32 until the first side 38.1 of the frame 38 is in contact with the first end face 34.5 of the container 18, as illustrated in FIG. 6C.

According to another embodiment, the opening has an I shape and comprises a first rectangular portion 32.1 and two expanded rectangular portions 32.2, arranged on both sides of the first rectangular portion 32.1.

Regardless of the embodiment, the dispensing system 20 and the opening 32 of the container 18 have shapes that work together in such a way as to form a sliding connection 28 ensuring a detachable connection between the container 18 and the dispensing system 20.

According to a configuration, the dispensing system 20 comprises a first wing 54.1 configured to slide into at least a first cutout made at a first edge of the opening 32 as well as a second wing 54.2 configured to slide into at least a second cutout made at a second edge of the opening 32. The invention makes it possible to create a detachable connection between the dispensing system 20 and the container 18 without an element connected to the container 18.

The invention claimed is:

1. A storing and dispensing device, comprising:

a container (18) for a bulk product (26); a dispensing system (20) that has an orifice (22) and a closing means (24) configured to move between an open state, in which the closing means at least partially frees up the orifice (22) and allows flow of the bulk product (26), and a closed state, in which the closing means closes off the orifice (22) and prevents the flow of the bulk product (26), wherein the container (18) is a rigid or semi-rigid box used to package the bulk product (26) from a production and/or packaging site to a sales point, wherein the container (18) comprises an opening (32) configured so that the bulk product (26) flows outside of the container (18) via the dispensing system (20), wherein the storing and dispensing device comprises a sliding connection (28) ensuring a detachable connection between the container (18) and the dispensing system (20), wherein the sliding connection (28) comprises both first and second wings (54.1, 54.2), integral with the dispensing system (20), as well as C shapes at the opening (32) ensuring the operation of guides (56.1, 56.2) for guiding the wings (54.1, 54.2), and wherein the opening (32) comprises: a first rectangular portion (32.1) that has a width (L32.1) that is smaller than a width (L) separating the outside edges of the wings (54.1, 54.2) and larger than the width (L40) of a body (40) of the dispensing system (20) at which the orifice (22) is made and on which the closing means (24) is mounted, and at least a second portion (32.2), rectangular and expanded, which has a width (L32.2) that is larger than the width (L) of the wings (54.1, 54.2) and which has ends arranged on both sides of the first portion (32.1) and which each describe a C shape that ensures the operation of guides (56.1, 56.2).

2. The storing and dispensing device according to claim 1, wherein the sliding connection (28) is created by cooperating shapes of the dispensing system (20) and the opening (32) of the container (18).

3. The storing and dispensing device according to claim 2, wherein the opening (32) is delimited by a pre-scored line (36) made on a wall of the container (18), the pre-scored line (36) being configured to be cut out in such a way as to create the opening (32) when the container (18) is converted into a part of the storing and dispensing device.

4. The storing and dispensing device according to claim 2, wherein the body (40) is connected to a frame (38), and the body (40) comprises: a semi-cylindrical wall (40.1) whose first end is connected to a first side (38.1) of the frame (38) and whose second end is extended by a flat wall (40.2) connected to a second side (38.2) of the frame (38) opposite to the first side (38.1), with the orifice (22) being made at the lower half of the semi-cylindrical wall (40.1), a first side wall (40.3) that connects the semi-cylindrical wall (40.1) and the flat wall (40.2) to a third side (38.3) of the frame (38), a second side wall (40.4) that connects the cylindrical wall (40.1) and the flat wall (40.2) to a fourth side (38.4) of the frame (38), opposite to the third side (38.3), a tab (48), one end (48.1) of which is connected to the body (40), between the orifice (22) and the first side (38.1) of the frame (38), with said tab (48) extending downward and being inclined in relation to the vertical to direct a stream of the bulk product (26) that flows from the orifice (22) when the dispensing system (20) is mounted on the container (18) ready to dispense the bulk product.

5. The storing and dispensing device according to claim 1, wherein the dispensing system (20) comprises a frame (38) that delimits a passage for the bulk product (26) and that has two opposite sides (38.3, 38.4) formed as thin coplanar bands of material that constitute the first and second wings (54.1, 54.2).

6. The storing and dispensing device according to claim 5, wherein the opening (32) is delimited by a pre-scored line (36) made on a wall of the container (18), the pre-scored line (36) being configured to be cut out in such a way as to create the opening (32) when the container (18) is converted into a part of the storing and dispensing device.

7. The storing and dispensing device according to claim 5, wherein the body (40) is connected to the frame (38), and the body (40) comprises: a semi-cylindrical wall (40.1) whose first end is connected to a first side (38.1) of the frame (38) and whose second end is extended by a flat wall (40.2) connected to a second side (38.2) of the frame (38) opposite to the first side (38.1), with the orifice (22) being made at the lower half of the semi-cylindrical wall (40.1), a first side wall (40.3) that connects the semi-cylindrical wall (40.1) and the flat wall (40.2) to a third side (38.3) of the frame (38), a second side wall (40.4) that connects the cylindrical wall (40.1) and the flat wall (40.2) to a fourth side (38.4) of the frame (38), opposite to the third side (38.3), a tab (48), one end (48.1) of which is connected to the body (40), between the orifice (22) and the first side (38.1) of the frame (38), with said tab (48) extending downward and being inclined in relation to the vertical to direct a stream of the bulk product (26) that flows from the orifice (22) when the dispensing system (20) is mounted on the container (18) ready to dispense the bulk product.

8. The storing and dispensing device according to claim 1, wherein the opening (32) has a T shape, with the second expanded rectangular portion (32.2) being positioned above the first portion (32.1) when the container (18) is positioned ready to dispense the bulk product.

9. The storing and dispensing device according to claim 8, wherein the opening (32) is separated from an end face of the container (18) by a distance such that the opening (32) coincides with the passage of the frame (38) when said frame (38) is in contact with the end face of the container (18).

10. The storing and dispensing device according to claim 9, wherein the opening (32) is delimited by a pre-scored line (36) made on a wall of the container (18), the pre-scored line (36) being configured to be cut out in such a way as to create the opening (32) when the container (18) is converted into a part of the storing and dispensing device.

11. The storing and dispensing device according to claim 8, wherein the opening (32) is delimited by a pre-scored line (36) made on a wall of the container (18), the pre-scored line (36) being configured to be cut out in such a way as to create the opening (32) when the container (18) is converted into a part of the storing and dispensing device.

12. The storing and dispensing device according to claim 1, wherein the opening (32) is delimited by a pre-scored line (36) made on a wall of the container (18), the pre-scored line (36) being configured to be cut out in such a way as to create the opening (32) when the container (18) is converted into a part of the storing and dispensing device.

13. The storing and dispensing device according to claim 1, wherein the body (40) is connected to a frame (38), and the body (40) comprises: a semi-cylindrical wall (40.1) whose first end is connected to a first side (38.1) of the frame (38) and whose second end is extended by a flat wall (40.2) connected to a second side (38.2) of the frame (38) opposite to the first side (38.1), with the orifice (22) being made at the lower half of the semi-cylindrical wall (40.1), a first side wall (40.3) that connects the semi-cylindrical wall (40.1) and the flat wall (40.2) to a third side (38.3) of the frame (38), a second side wall (40.4) that connects the cylindrical wall (40.1) and the flat wall (40.2) to a fourth side (38.4) of the frame (38), opposite to the third side (38.3), a tab (48), one end (48.1) of which is connected to the body (40), between the orifice (22) and the first side (38.1) of the frame (38), with said tab (48) extending downward and being inclined in relation to the vertical to direct a stream of the bulk product (26) that flows from the orifice (22) when the dispensing system (20) is mounted on the container (18) ready to dispense the bulk product.

14. A storing and dispensing device, comprising: a container (18) for a bulk product (26); a dispensing system (20) that has an orifice (22) and a closing means (24) configured to move between an open state, in which the closing means at least partially frees up the orifice (22) and allows flow of the bulk product (26), and a closed state, in which the closing means closes off the orifice (22) and prevents the flow of the bulk product (26), wherein the container (18) is a rigid or semi-rigid box used to package the bulk product (26) from a production and/or packaging site to a sales point, wherein the container (18) comprises an opening (32) configured so that the bulk product (26) flows outside of the container (18) via the dispensing system (20), wherein the storing and dispensing device comprises a sliding connection (28) ensuring a detachable connection between the container (18) and the dispensing system (20), wherein the sliding connection (28) comprises both first and second wings (54.1, 54.2), integral with the dispensing system (20), as well as C shapes at the opening (32) ensuring the operation of guides (56.1, 56.2) for guiding the wings (54.1, 54.2), and wherein the dispensing system (20) comprises a body (40), connected to a frame (38), which comprises: a semi-cylindrical wall (40.1) whose first end is connected to a first side (38.1) of the frame (38) and whose second end is extended by a flat wall (40.2) connected to a second side (38.2) of the frame (38) opposite to the first side (38.1), with the orifice (22) being made at the lower half of the semi-cylindrical wall (40.1), a first side wall (40.3) that connects the semi-cylindrical wall (40.1) and the flat wall (40.2) to a third side (38.3) of the frame (38), a second side wall (40.4) that connects the cylindrical wall (40.1) and the flat wall (40.2) to a fourth side (38.4) of the frame (38), opposite to the third side (38.3), a tab (48), one end (48.1) of which is connected to the body (40), between the orifice (22) and the first side (38.1) of the frame (38), with said tab (48) extending downward and being inclined in relation to the vertical to direct a stream of the bulk product (26) from the orifice (22) when the dispensing system (20) is mounted on the container (18) ready to dispense the bulk product.

* * * * *